US005771645A

United States Patent [19]

Porter

[11] Patent Number: 5,771,645

[45] Date of Patent: Jun. 30, 1998

[54] ELECTRICAL ACCESS IN STRUCTURAL INSULATED FOAM CORE PANELS

[76] Inventor: William H. Porter, P.O. Box 249, Saugatuck, Mich. 49453

[21] Appl. No.: 632,633

[22] Filed: Apr. 12, 1996

[51] Int. Cl.[6] ..... E04F 17/08

[52] U.S. Cl. ..... 52/220.2; 52/220.3; 52/309.9; 29/897

[58] Field of Search ..... 52/220.1, 220.2, 52/220.3, 22.07, 309.9, 309.7; 174/65 R, 66, 67, 68.1, 68.2, 68.3, 95, 101, 110 R; 29/897, 897.1

[56] References Cited

U.S. PATENT DOCUMENTS

| | | | |
|---|---|---|---|
| 3,707,165 | 12/1972 | Stahl | 52/220.2 X |
| 3,892,095 | 7/1975 | Vankuik et al. | 52/220.1 X |
| 5,465,541 | 11/1995 | Lin et al. | 52/220.3 X |

*Primary Examiner*—Beth A. Aubrey
*Attorney, Agent, or Firm*—Emrich & Dithmar

[57] ABSTRACT

A generally planar structural panel includes first and second opposed outer facings with an insulating foam core disposed therebetween. Prior to attachment to the two outer facings, which may be of virtually any of the more common building materials, cuts are made in the foam core extending the length and width thereof. These cuts are in the form of linear elongated slots or channels and are made in the foam so as to form a plurality of thin elongated foam strips within each channel. The cuts may be made using a hot wire in a conventional manner during manufacture without removing the thus formed foam strips. The outer facings are then attached to opposed surfaces of the foam core. Each group of adjacent foam strips may be accessed by cutting a hole in an outer facing of the panel and into the foam to the depth of the strips. The thin foam strips may then be pulled out of the foam core through the thus cut hole to form an elongated, linear slot in the panel extending the length or width thereof which may be used as an electrical wiring chase. In another embodiment, the thin foam strips are removed during manufacture and the thus formed wiring chase is filled with loose filled foam with the ends of the chase sealed with tape. In the field at a job site, the tape may be removed and the loose fill foam vacuumed from the foam core in forming a wiring chase.

21 Claims, 2 Drawing Sheets

ELECTRICAL ACCESS IN STRUCTURAL INSULATED FOAM CORE PANELS

FIELD OF THE INVENTION

This invention relates generally to insulated structural panels and is particularly directed to providing electrical access in structural insulated foam core panels having opposed outer facings.

BACKGROUND OF THE INVENTION

Structural insulated panels are frequently used in building construction. The basic unit in the structural insulated panel construction approach employs two rigid faces on either side of a light insulated foam core. This approach requires good adhesion of the faces to the core to form a structural I-beam. Panels of this type are typically joined with lumber and nails. A more recent approach uses steel studs rather than the conventional 2x dimensional structural lumber members and nails and in some cases employs metal edges on the panels for increased strength. The foam core affords good thermal insulation, while the two rigid faces offer strength and rigidity.

Providing electrical wiring access in these foam core insulated panels presents a problem. Wiring chases are typically in the form of round or square channels, or slots, formed by removing a portion of the foam core during manufacture at the factory. Frequently a standard number of wiring chases at predetermined locations within the foam core are provided even though not all are used when the panel is incorporated in a building structure. Unused wiring chases unnecessarily increase thermal transfer and heat loss through the panel. Cutting a hole through an outer facing and into the foam core to accommodate an electrical box in communication with a wiring chase is a difficult process. The rectangular cut for the electrical access box is generally wider than the typical 1" diameter round electrical wiring chase. As a result, the plug formed by the rectangular cut for the electrical access box cannot be cleanly removed from the foam core which is frequently torn and damaged during the process.

The present invention addresses the aforementioned limitations of the prior art by providing electrical access in a structural insulated foam core panel which involves removal of only that portion of the foam core necessary to form the desired electrical chase so as not to compromise the insulating characteristics of the panel. The electrical chase may be formed in the field on a job site as dictated by the electrical requirements of the building structure.

OBJECTS AND SUMMARY OF THE INVENTION

Accordingly, it is an object of the present invention to provide electrical access in structural insulated foam core panels having opposed outer facings.

It is another object of the present invention to provide a foam core insulated structural panel with a plurality of wiring chases pre-cut during manufacture while allowing for removal of foam strips in forming the desired wiring chases in the field at the job site.

It is yet another object of the present invention to provide electrical access in structural insulated foam core panels in the field at a job site by removing only the minimal amount of foam necessary to form the inner wire runs and to access these wire runs from outside of the panel in a manner which maintains the insulating characteristics of the panel.

A further object of the present invention is to provide a structural insulated foam core panel having pre-cut channels within the foam core for use as wiring chases which are filled with loose foam particles to permit only those channels corresponding to the desired wiring chases to be emptied of the loose foam particles by vacuum in the field at a job site.

A still further object of the present invention is to provide pre-cut wiring chases in a foam core of an insulated structural panel which are rectangular in cross section and dimensioned to accommodate a rectangular cut in the foam for installing a standard electrical access box.

This invention contemplates a structural insulated panel comprising a generally planar insulating core comprised of foam plastic; first and second rigid facings attached to opposed lateral portions of the core; a cutout portion of the core extending between opposed edges of the core, the cutout portion comprised of a plurality of elongated, linear, thin foam sections; and a plug cut into and removed from one of the facings and an adjacent portion of the core to provide access to the cutout portion of the core to permit the foam sections to be removed from the cutout portion in forming a wiring chase within the panel extending between opposed edges thereof.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
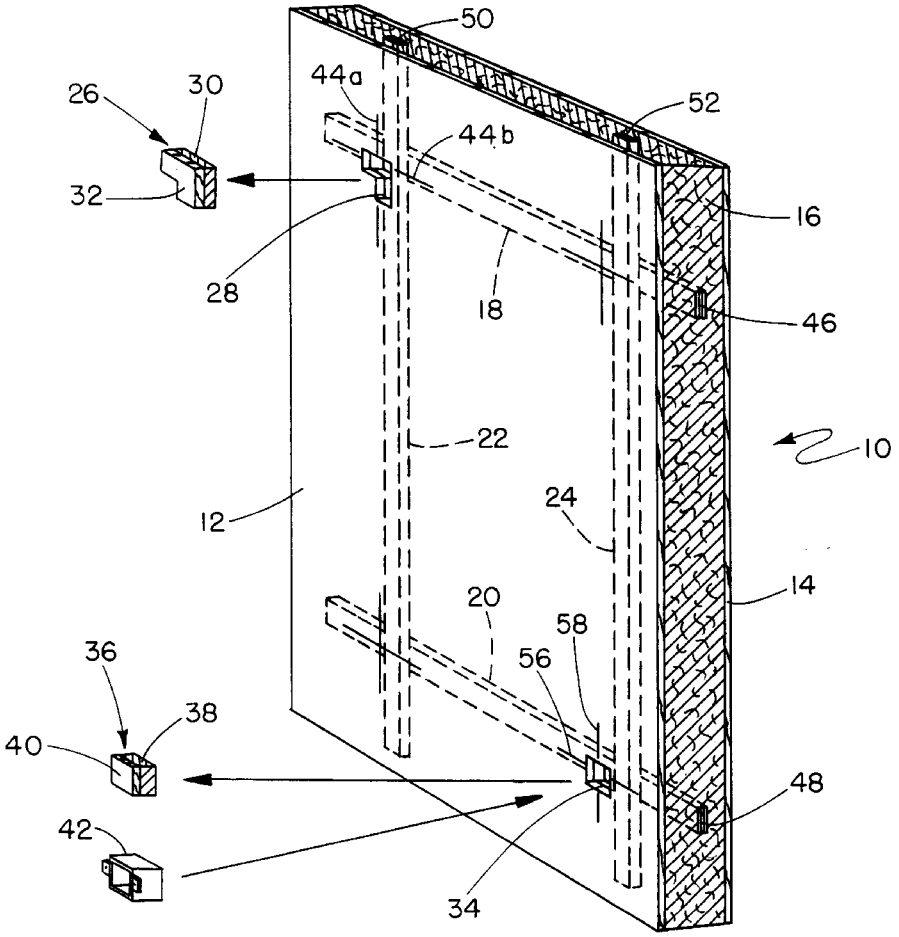
FIG. 1 is a perspective view shown partially in phantom of a structural insulated foam core panel provided with electrical access in accordance with the principles of the present invention.

Referring to FIG. 1, there is shown a perspective view partially in phantom of a structural insulated foam core panel 10 in accordance with the principles of the present invention. Panel 10 includes a solid inner insulating foam core 16 and first and second outer facings 12 and 14. First and second outer facings 12, 14 are securely attached to opposed lateral surfaces of the insulating foam core 16 by conventional means such as an adhesive. First and second outer facings 12, 14 are of a rigid construction and may be formed from any of the more conventional building materials such as plywood, drywall, composite gypsum, metal or oriented strand board. The combination of the inner foam core 16 and the first and second outer facings 12, 14 forms a generally planar, rectangular structure suitable for use in building construction such as in a wall or roof. The insulating core 16 of panel 10 is preferably comprised of plastic foam and affords high insulating values.

Disposed within insulating foam core 16 are first and second pre-cut elongated, linear sets of foam strips 46 and 48. Each of the first and second sets of foam strips 46, 48 are arranged in a spaced manner relative to one another within the insulating foam core 16 and are aligned generally horizontally. Also disposed within insulating foam core 16 are a third and fourth pre-cut sets of foam strips 50 and 52. The third and fourth sets of foam strips 50, 52 are arranged in a spaced manner horizontally from one another and are aligned generally vertically within the insulating foam core 16. Each of the aforementioned sets of foam strips extend either the full height or width of the insulating foam core 16 and terminate at opposed edges of the foam core.

Figure 2:
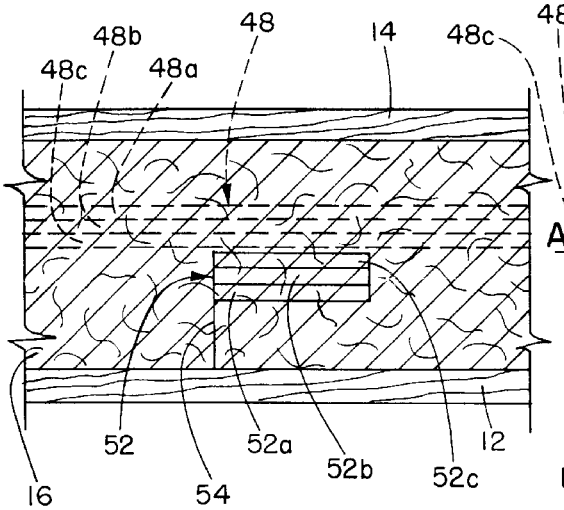
FIG. 2 is a partial sectional view of the structural foam core panel of FIG. 1 illustrating the relative position and orientation of two groups of pre-cut foam strips for use in forming wiring chases within the panel's foam core in accordance with the present invention.
Figure 3:
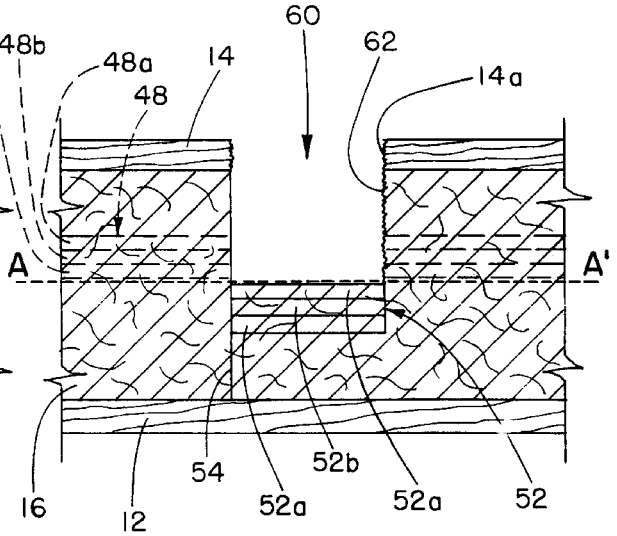
FIG. 3 is a partial sectional view of a portion of a structural insulated foam core panel in accordance with the present invention illustrating the location of a slot cut into the panel for accessing pre-cut strips within the foam core for forming a wiring chase therein.

With reference also to FIGS. 2 and 3 which are partial sectional views of the panel 10 shown in FIG. 1, additional details of the invention will now be described. The sectional views of FIGS. 2 and 3 show additional details of the arrangement of the first and second outer facings 12, 14 and the inner insulating foam core 16. Each of FIGS. 2 and 3 is taken along a horizontal plane extending through the panel. Thus, the second horizontal set of foam strips 48 is shown lengthwise in dotted line form in the figures, while the fourth vertical set of foam strips 52 is shown extending out of the plane of FIGS. 2 and 3. From FIGS. 2 and 3, it can be seen that each of the sets of foam strips includes three separate strips arranged in a side-by-side configuration and extending the height or width of the insulated foam core panel. Thus, the second set of foam strips 48 includes first, second and third foam strips 48*a*, 48*b* and 48*c*. Similarly, the fourth set of foam strips 52 includes individual foam strips 52*a*, 52*b* and 52*c*. Each of the aforementioned strips is formed in the foam core 16 by forming a cut line 54 as shown in FIGS. 2 and 3 in the foam core prior to attachment of the first outer facing 12 to the inner foam core. Cut line 54 is formed in a conventional manner in the insulating foam core 16 by means of a hot wire (not shown for simplicity) introduced into and displaced within the foam core. Following formation of the cut line 54 by the hot wire within the inner insulating core 16, the wire is then displaced within the foam core so as to form three thin foam strips 52*a*, 52*b* and 52*c*. The hot wire is then removed from the insulating foam core 16 via the previously formed cut line 54. The three thin foam strips 52*a*, 52*b* and 52*c* extend the full height of foam core panel 10. The second set of foam strips 48 are similarly formed within the insulating inner core 16 by means of a hot wire and includes the aforementioned first, second and third thin foam strips 48*a*, 48*b* and 48*c*. Each of the thin foam strips 48*a*, 48*b* and 48*c* extends the full width of the foam core panel 10.

The horizontally aligned sets of foam strips are vertically offset from the vertically aligned sets of foam strips. This can be seen in the perspective view of FIG. 1 as well as in the partial sectional views of FIGS. 2 and 3. In FIG. 3 there is shown in dotted line form a center plane designated as A-A' which extends vertically through the center of the foam core panel. From FIGS. 2 and 3, it can be seen that the second sets of foam strips 48 and the fourth sets of foam strips 52 are disposed on opposite sides of the center plane A-A'. Vertically offsetting the vertical and horizontal sets of foam strips allows the individual foam strips to be pulled either the entire height or width of the panel without interruption as described below.

With reference specifically to FIG. 1, there is shown the manner in which the various pre-cut sets of foam strips are accessed in forming wiring chases within the foam core panel 10. Thus, in one example, a first replacement plug 26 is cut in the first outer facing 12 as well as in a portion of the inner insulating foam core 16. The first replacement plug 26 thus is comprised of an inner foam portion 30 and an outer facing portion 32. The first replacement plug 26 is cut into the foam core panel 10 where the horizontally aligned first set of foam strips 46 overlap the vertically aligned third set of foam strips 50. Cross hair lines 44*a* and 44*b* may be located on the first outer panel to indicate the location of overlap of the first and third sets of foam strips 46, 50 within the foam core 16. The first replacement plug 26 is generally L-shaped and extends along a portion of the length of the first set of foam strips 46 as well as along a portion of the length of the third set of foam strips 50. The first replacement plug 26 may be formed by conventional means in the foam core panel 10 such as by cutting with a jig saw through the first outer facing 12 and into a portion of the inner foam core 16. When the L-shaped first replacement plug 26 is removed, access to the first and third sets of foam strips 46, 50 within the foam core 16 is provided through the thus formed aperture 28 permitting each of the thin strips in these two sets of foam strips to be removed from the foam core as described below. FIG. 1 also shows a second replacement plug 36 cut into and removed from a lower portion of the foam core panel 10 where the second set of foam strips 48 overlaps the fourth sets of foam strips 52. The second replacement plug 36 also is comprised of an inner foam portion 38 and an outer facing portion 40. Removal of the rectangular or square shaped second replacement plug 36 after it is cut into the foam core panel 10 results in the formation of an aperture 34 through which the fourth set of foam strips 52 may be removed from the inner foam core 16 as described below.

After the foam strips are removed from the inner foam core 16, the first replacement plug 26 may be re-inserted in aperture 28 and securely maintained therein by means of an adhesive (not shown) applied to the plug. In another arrangement as shown for the case of the second replacement plug 36, a standard electrical box 42 may be inserted in the aperture 34 formed by the removal of the second replacement plug. Electrical box 42 may be provided with catch tabs for maintaining it securely in position within the foam core panel 60. Electrical box 42 is adapted for receiving and enclosing a conventional electrical component such as a switch or outlet plug coupled to the wires running through the wiring chase within the panel. As shown in FIG. 1, removal of the first through fourth sets of foam strips 46, 48, 50 and 52 from the panel's inner foam core 16 forms first through fourth wiring chases 18, 20, 22 and 24, respectively, which are shown in the figure in dotted line form. Each of the thus formed wiring chases is adapted to receive electrical wires extending through the foam core panel 10.

Referring to FIG. 3, there is shown another arrangement where an aperture, or slot, 60 is cut into the foam core panel in order to access the fourth vertically aligned set of foam strips 52. In the sectional view of FIG. 3, aperture 60 is comprised of a cut-out portion 14*a* of the second outer facing 14 and a cut-out portion 62 of the inner foam core 16. Aperture 60 in FIG. 3 is disposed above, or out of the plane, of the second set of foam strips 48 and to a depth within the foam core 16 so as to permit access to the first, second and third thin strips 52*a*, 52*b* and 52*c* of the fourth set of foam strips 52. Aperture 60 is adapted to receive either the removed portion of the panel or a conventional electrical component as previously described.

Figure 4:
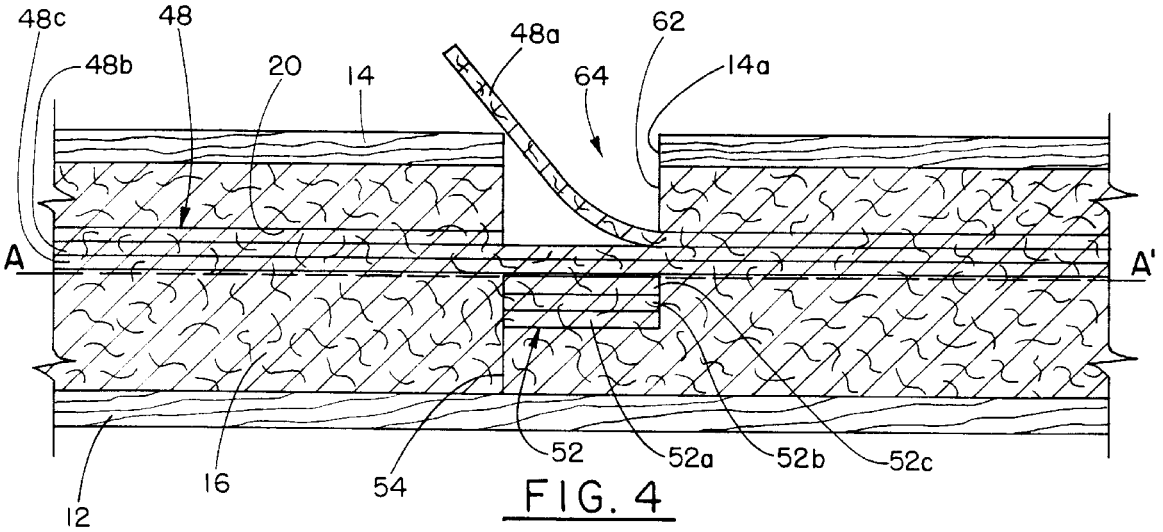
FIG. 4 is a partial sectional view of a structural insulated foam core panel in accordance with the present invention illustrating the manner in which the pre-cut strips may be removed from the foam core in forming a wiring chase therein.

Referring to FIG. 4, there is shown the manner in which the cut foam strips are removed from the panel's foam core 16 in forming a wiring chase therein. In the foam core panel shown in FIG. 4, an aperture, or slot, 64 has been cut into the panel forming a cut-out notch 14*a* in the outer facing 14 and a cut-out portion 62 in the panel's foam core 16. Aperture 64 is cut into the panel to a depth so as to access the second set of foam strips 48 which includes strips 48*a*, 48*b* and 48*c*. As shown in the figure, the first strip 48*a* is first removed from the panel via the aperture 64 therein. The thin, flat shape in combination with the flexibility of the foam strips 48*a*, 48*b* and 48*c* allows each strip to be pulled out from the foam core 16 through aperture 64 without breaking. With the three foam strips 48*a*, 48*b* and 48*c* removed, a wiring chase 20 is formed in the panel and is accessible through aperture 64. If the depth of aperture 64 is extended to the fourth set of foam strips 52, each of these strips 52*a*, 52*b* and 52*c* may also be removed via the thus cut aperture. As indicated above, the sets of foam strips 48 and 52 are located on opposite sides of a plane A-A' shown in dotted line form in the figure passing through the center of the foam core panel.

Figure 5:
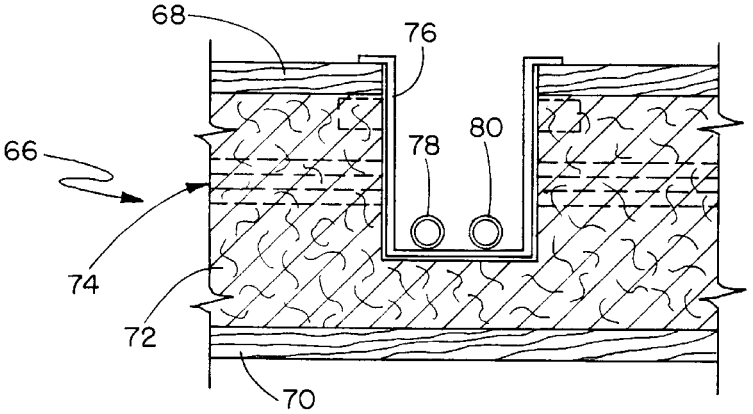
FIG. 5 is a partial sectional view of the inventive structural insulated foam core panel incorporating an electrical box for accessing a pair of wire conductors disposed within a wiring chase within the panel's foam core.

Referring to FIG. 5, there is shown a partial sectional view of a structural insulated foam core panel 66 in which an electrical box 76 has been installed for accessing a pair of wires as 78 and 80 disposed in a wiring chase orthogonally oriented relative to the plane of the figure. The foam core panel 66 includes first and second outer facings 68 and 70 as well as an inner foam core 72 disposed therebetween and attached to the two outer facings. A slot has been cut through outer facing 68 and into the inner foam core 72. Electrical box 76 has been inserted into the thus cut slot which is disposed above a set of horizontally aligned foam strips 74 shown in dotted line form. Electrical box 76 extends into the foam core 72 to a depth so as to accommodate a pair of electrical conductors 78 and 80 disposed within the aforementioned vertically oriented wiring chase formed as previously described. Electrical box 76 may be provided with a pair of tabs 76*a* and 76*b* (shown in dotted line form) for securely maintaining the electrical box in position.

Figure 6:
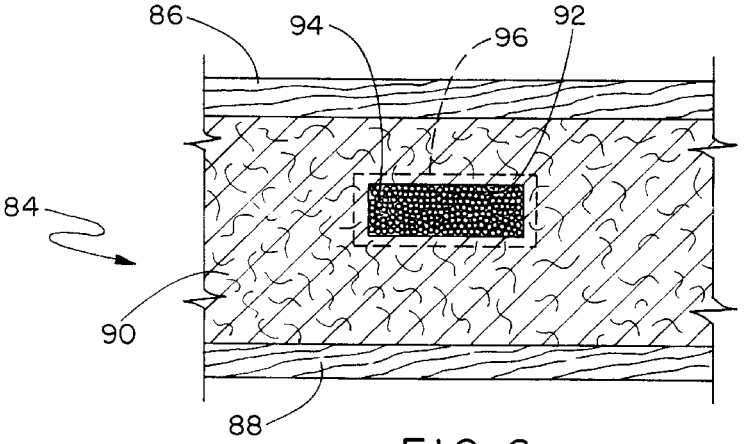
FIG. 6 is a partial sectional view of another embodiment of the inventive structural insulated foam core panel including loose foam fill inserted in pre-cut wiring chases within the panel's foam core which may be removed in the field on a job site if needed.

Referring to FIG. 6, there is shown a partial sectional view of another embodiment of a structural insulated foam core panel 84 in accordance with the present invention. As in the previously described embodiments, foam core panel 84 includes first and second outer facings 86 and 88 and a foam core 90 disposed therebetween and securely attached to the two outer facings. Disposed within the inner foam core 80 is a wiring chase 92 formed as previously described. In the embodiment of FIG. 6, wiring chase 92 has been filed with loose fill 94 preferably in the form of small foam particles. The ends of the wiring chase 92 are then sealed by conventional means such as a strips of tape 96 shown in the figure in dotted line form. In the field, if it is desired to use the wiring chase 92 for carrying electrical wires, the tape strip 96 is removed from both ends of the wiring chase and the loose foam fill 94 is removed such as by vacuuming. Electrical wires may be then run through the wiring chase 92. If the wiring chase 92 is not needed, the loose foam fill 94 is left within the wiring chase 92 and the insulating characteristics of the foam core panel 84 are not reduced by a void formed by the empty wiring chase.

There has thus been shown an arrangement for providing electrical access in structural insulated foam core panels involving the removal of only a minimal amount of foam from the core in order to maintain the insulating characteristics of the panel. The inventive approach includes one or more pre-cut sets of foam strips formed in the core during manufacture prior to attachment of a pair of rigid outer facings to the core. Each of the foam strips is thin and flat in dimension and is elongated and generally linear in shape and is flexible. The foam strips extend between opposed edges of the panel and may be oriented either vertically or horizontally. The foam strips are accessed by cutting a hole through an outer facing of the panel and into its foam core to a depth of the pre-cut set of foam strips. The foam strips may be removed from the core through the thus cut aperture by pulling the strips through the aperture. The thin, flexible nature of the strips allows them to be removed in this manner. Removal of the foam strips forms a wiring chase within the panel's foam core allowing electrical wires to be drawn through the panel. An electrical box may be inserted in the cut aperture in the panel for accessing wires drawn through the thus formed wiring chase. Horizontally and vertically oriented wiring chases are disposed in different vertical planes within the foam core to permit accessing and removing either a group of adjacent horizontal or vertical foam strips without disturbing orthogonally oriented strips in order to maintain the insulating characteristics of the panel. The inventive approach allows various pre-cut strips to be formed in the panel during manufacture, while allowing only certain groups of foam strips to be removed in the field on a job site as dictated by the wiring requirements of the structure. This approach assures only that portion of the inner foam core necessary for forming the desired wiring chase is removed from the foam core to maintain the insulating characteristics of the panel. In another embodiment, the thin foam strips are removed during manufacture and the thus formed wiring chase is filled with loose fill foam with the ends of the chase sealed with tape. In the field at a job site, the tape may be removed and the loose fill foam removed such as by vacuum in forming a wiring chase.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A structural insulated panel comprising:

a generally planar insulating core comprised of foam plastic;

first and second rigid facings attached to opposed lateral portions of said core;

a cutout portion disposed in and formed of said core and extending between opposed edges of said core, said cutout portion comprised of a plurality of elongated, linear, thin foam sections; and a plug cut out of and removed from one of said facings and an adjacent portion of said core to form an aperture in the panel in providing access to said cutout portion of said core to permit said foam sections to be removed from said cutout portion through said aperture in forming a wiring chase within the panel extending between opposed edges thereof.

2. The structural insulated panel of claim 1 further comprising an electrical box inserted in the aperture formed by removal of said plug for accessing electrical wires disposed in said wiring chase.

3. The structural insulated panel of claim 1 wherein said panel includes first and second cutout portions of said core arranged in an overlapping manner in said core and extending between respective pairs of opposed edges of said core, wherein each of said cutout portions is comprised of a respective plurality of elongated, linear, thin foam sections.

4. The structural insulated panel of claim 3 further comprising first and second lines disposed on said one of said facings and respectively aligned with said first and second cutout portions for indicating the location of overlap of said first and second cutout portions.

5. The structural insulated panel of claim 3 wherein said aperture is located where said first and second cutout portions overlap for providing access to the foam sections in each of said first and second cutout portions.

6. The structural insulated panel of claim 5 wherein said first and second cutout portions are aligned orthogonally and said aperture is generally L-shaped, extending along the lengths of said first and second cutout portions.

7. The structural insulated panel of claim 6 wherein said first and second cutout portions are vertically displaced from each other within said insulating foam core.

8. The structural insulated panel of claim 7 wherein said insulating foam core includes a vertically oriented center plane extending therethrough, and wherein said first and second cutout portions are disposed on opposed sides of said center plane.

9. The structural insulated panel of claim 8 wherein said first and second cutout portions are respectively oriented vertically and horizontally.

10. The structural insulated panel of claim 1 wherein said first and second facings are comprised of plywood, drywall, composite gypsum or oriented strand board.

11. A structural insulated panel comprising: a generally planar insulating core comprised of foam plastic; first and second rigid facings attached to opposed lateral portions of said core; a cutout portion disposed in and formed of said core and extending between opposed edges of said core, said cutout portion comprised of a plurality of elongated, linear thin foam sections; and a plug cut out of removable from one of said facings and an adjacent portion of said core to form an aperture in the panel in providing access to said cutout portion of said core to permit said foam sections to be removed from said cutout portion through the aperture in forming a wiring chase within the panel extending between opposed edges thereof, wherein said plug is reinsertable in said aperture following removal of said foam sections from said cutout portion for covering said wiring chase.

12. The structural insulated panel of claim 11 further comprising adhesive means for securely maintaining said plug in position within the aperture in said panel.

13. The structural insulated panel of claim 11 wherein said plug is rectangular in shape and has substantially the same width as said cutout portion.

14. A structural insulated panel comprising:

a generally planar insulating core comprised of foam plastic;

first and second rigid facings attached to opposed lateral portions of said core;

an elongated wiring chase disposed in said insulating core and having a first end in a first edge of said insulating core and a second end in a second, opposed edge of said insulating core;

a plurality of insulating foam particles loosely disposed within said wiring chase; and removable sealing means disposed over the first and second ends of said wiring chase for confining said foam particles therein, while permitting said foam particles to be removed from said wiring chase to allow electrical wire to be drawn therethrough when said sealing means is removed.

15. The structural insulated panel of claim 14 wherein said removable sealing means includes adhesive tape.

16. The structural insulated panel of claim 14 wherein said first and second rigid facings are comprised of plywood, drywall, composite gypsum or oriented strand board.

17. A method for providing electrical access in a structural insulated panel having an inner foam core and first and second opposed outer facings, said method comprising the steps of:

cutting a plurality of immediately adjacent, elongated, linear, thin foam strips in an inner portion of the foam core, said foam strips extending between opposed edges of the foam core;

attaching the first and second facings to opposed outer lateral portions of said foam core;

cutting and removing a portion of one of the outer facings and an adjacent portion of the foam core to form an aperture for accessing said plurality of foam strips therein;

removing said foam strips from the foam core via said aperture in forming a wiring chase within the foam core; and sealing the aperture and enclosing said wiring chase.

18. The method of claim 17 wherein the step of sealing the aperture includes inserting the removed portion of said one of the outer facings and said adjacent portion of the foam core into said aperture.

19. The method of claim 17 further comprising the step of cutting first and second pluralities of respective immediately adjacent, elongated, linear thin foam strips in an inner portion of the foam core, and wherein said first and second pluralities of foam strips are respectively aligned horizontally and vertically.

20. The method of claim 19 further comprising the step of forming said first and second pluralities of foam strips in a vertically offset manner.

21. The method of claim 17 wherein the step of sealing the aperture includes inserting an electrical box into said aperture.

* * * * *